US008322923B2

(12) United States Patent
Gum

(10) Patent No.: US 8,322,923 B2
(45) Date of Patent: Dec. 4, 2012

(54) FILM BAG WITH HANDLE

(75) Inventor: Mark W. Gum, East Prairie, MO (US)

(73) Assignee: Mondi Jackson, Inc, Jackson, MO (US)

( * ) Notice: Subject to any disclaimer, the term of this patent is extended or adjusted under 35 U.S.C. 154(b) by 310 days.

(21) Appl. No.: 12/815,537

(22) Filed: Jun. 15, 2010

(65) Prior Publication Data

US 2011/0305407 A1 Dec. 15, 2011

(51) Int. Cl.

| | |
|---|---|
| ***B65D 33/06*** | (2006.01) |
| ***B65D 30/20*** | (2006.01) |
| ***B31B 1/62*** | (2006.01) |
| ***B31B 1/86*** | (2006.01) |

(52) U.S. Cl. ..... 383/26; 383/17; 383/20; 383/21; 383/120; 493/221; 493/226; 493/926

(58) Field of Classification Search ..... 383/26, 383/27, 17, 20, 21, 28, 29, 12, 14, 7, 22, 383/24, 120; 493/221, 226, 926

See application file for complete search history.

(56) References Cited

U.S. PATENT DOCUMENTS

| | | | | |
|---|---|---|---|---|
| 2,006,786 | A * | 7/1935 | Beauvisage | 16/407 |
| 2,236,681 | A * | 4/1941 | Goldschmidt | 206/411 |
| 2,773,635 | A * | 12/1956 | Stelzer | 206/390 |
| 3,490,681 | A * | 1/1970 | Niemeyer | 383/20 |
| 3,504,845 | A * | 4/1970 | Niemeyer | 383/20 |
| 3,507,194 | A * | 4/1970 | Schwarzkopf | 493/196 |
| 7,670,050 | B2 * | 3/2010 | Haimerl et al. | 383/28 |
| 7,866,885 | B2 * | 1/2011 | Kujat et al. | 383/6 |
| 2008/0013866 | A1 | 1/2008 | Kujat | |
| 2008/0080794 | A1 * | 4/2008 | Kruse et al. | 383/14 |
| 2010/0067830 | A1 | 3/2010 | Angiolini | |
| 2011/0033133 | A1 * | 2/2011 | Kujat | 383/20 |
| 2011/0229060 | A1 * | 9/2011 | Koesters | 383/21 |

FOREIGN PATENT DOCUMENTS

| | | | |
|---|---|---|---|
| EP | 553693 | A2 * | 8/1993 |
| EP | 2039620 | A1 * | 3/2009 |
| GB | 1180237 | A * | 2/1970 |
| WO | WO 9410046 | A1 * | 5/1994 |
| WO | WO 2004022442 | A2 * | 3/2004 |
| WO | 2009095806 | A | 8/2009 |

* cited by examiner

*Primary Examiner* — Jes F Pascua
(74) *Attorney, Agent, or Firm* — Andrew Wilford

(57) ABSTRACT

A bag has a panel made of film and having an inner face and an outer face and formed with at least two throughgoing and spaced attachment holes. A carry handle has a pair of spaced ends each having an adhesive-coated face engaging the outer face over a respective one of the holes. Respective inner patches each have an adhesive-coated face engaging the inner face over a respective one of the holes and engaged through the respective hole with the end face.

18 Claims, 5 Drawing Sheets

12
15
14'
4
16
1
13
2
11
14
3

FILM BAG WITH HANDLE

FIELD OF THE INVENTION

The present invention relates to a film bag. More particularly this invention concerns a film bag with a carry handle and intended to carry bulk material, for instance powder or granules.

BACKGROUND OF THE INVENTION

A multilayer film bag is described in EP 1,712,482 having a layer of a heat-sealable material on the inside of the bag and a layer of non-sealable material on the outside of the bag. On the outside of the bag, a carry handle is provided that consists of a separate strip of film. For attaching the carry handle, the plastic film is provided with die-cut holes that are covered on the inner face of the bag by at least one film patch attached to the inner face of the bag. The carry handle has handle ends that are connected through the attachment holes with the film patch. In the context of the known measures, all connections are designed as thermal sealing seams that during the course of the bag manufacturing are to be applied in two separate sealing stations. Technically, this is complicated. Moreover, the complicated sealing stations limit the possibility of determine the positioning of the carry handle in a variable manner and to arrange it selectively on the front wall, the back wall, in a side gusset, or at the bottom of the bag. It is further disadvantageously that the handle ends of the carry handle do not abut with a flat surface against the plastic film from which the bag is made of, and that the edges of the die-cut holes are still visible after attaching the carry handle.

It is principally also known from WO 2008/084506 to glue carry handles consisting of strips of film on the outside of a bag. Similarly, WO 2009/095806 describes a film bag with a carry handle that has self-adhesive connecting surfaces coated with adhesive for attaching to the outer surface of the bag. However, adhesive connections between the outer layer of the bag and the handle ends of the carry handle have usually only a limited strength so that bags with carry handles glued to the outside can be used up to now only for relatively light packages, for example for stationery and toiletries.

OBJECTS OF THE INVENTION

It is therefore an object of the present invention to provide an improved film bag with handle.

Another object is the provision of such an improved film bag with handle that overcomes the above-given disadvantages, in particular that can be manufactured in a simple and cost-effective manner, the connection between the handle and the plastic film forming the bag being particularly strong.

A further object is to provide an improved method of making such a bag or at least of making a film web suitable for manufacture into a handle bag of the above-described type.

SUMMARY OF THE INVENTION

A bag has according to the invention a panel made of film and having an inner face and an outer face and formed with at least two throughgoing and spaced attachment holes. A carry handle has a pair of spaced ends each having an adhesive-coated face engaging the outer face over a respective one of the holes. Respective inner patches each have an adhesive-coated face engaging the inner face over a respective one of the holes and engaged through the respective hole with the end face.

The use according to the invention of a self-adhesive film patch and a carry handle that has self-adhesive connecting faces coated with adhesive greatly simplifies bag manufacture by eliminating sealing stations. Contact of the adhesive surfaces through the attachment holes creates a very strong connection between the film patches and the carry handle. It is further of advantage that due to their adhesive surfaces, the handle ends of the carry handle bond securely and in surface contact against the outer face of the panel and cover the attachment holes completely. The attachment according to the invention is also suitable for large packages with a high weight capacity of, for example, up to 20 kg. It is further of advantage that the positioning of the carry handle can be varied, for example at the front wall, the rear wall, in a side gusset, at the top or the bottom of the bag.

With respect to the arrangement of the attachment holes, with regard to the number of used film patches, and with respect to the configuration of the adhesive surfaces, different design possibilities arise within the context of the teachings according to the invention. Thus, a film patch can be used that covers the attachment holes for both handle ends of the carry handle. Alternatively, there is the possibility to providing the ends of the carry handle with respective films patches coated on the inner side of the bag over the full surface with adhesive.

According to a preferred embodiment of the invention, the plastic film is provided at each handle end with a plurality of attachment holes in the region of the film patches and the carry handle ends that are coated with adhesive. A plurality of attachment holes between which sections of the plastic film remain in the form of ribs increases the load-bearing zone and strengthens the connection to the plastic film forming the bag.

In all previously described embodiments, the adhesive layer of the connecting faces extends preferably to the edges of the film patch and the edges of the handle ends of the carry handle so that the handle ends and patches are bonded over their entire surfaces with the bag film. The carry handle can have a shape with wide handle ends and a narrower central handle area. The wide handle ends can be used to in bags with a plurality of holes at each end to optimize force transmission and load distribution.

To further strengthen the carry handle, an additional outer film patch can be provided on each of the handle ends of the carry handle of all the above-described embodiments, the outer film patch being all around the respective handle end to the outer face of the plastic film of the bag. Preferably, each outer film patch is glued, on the one hand, to the respective end of the carry handle and, on the other hand, is glued around the respective handle end to the plastic film.

The plastic film for manufacturing the bag is not subject to limitations with respect to material. In particular, laminates or can be used that have a sealable inner layer forming the inner face of the bag and a polymer that is characterized by a surface of high optical quality and that forms an outer layer. Further, the laminates can contain additional functional layers, for example for reducing water vapor and gas permeability. Suitable laminates are, for example, a layer made of polyethylene (PE) for the inner face of the bag and a layer made of polyethylene terephthalate (PET) or biaxially oriented polypropylene (BOPP) for the outer face of the bag. PET as well as BOPP are good to print on and are characterized by good mechanical properties. A potential functional layer can consist of a metallic film or metallized polymer, for example a metallized polyester (metPET). Preferred material combinations for the plastic film are PET/PE, PET/metPET/PE or also polyolefin combinations, for example PE/PE. For the carry handle such plastics can be selected that are characterized by good mechanical properties, in particular high strength. The carry handle can be composed of, for example, BOPP, PET or OPS and has preferably a thickness between 50 and 70 μm.

According to a preferred embodiment of the bag, the carry handle is provided in a side gusset panel of the bag and abuts flatly against the side panel. The carry handle does not project beyond the outer dimensions of the bag and therefore does not obstruct the stacking and transport of the bags. Preferably, the carry handle extends longitudinally of the side gusset and has a fold corresponding to the central bending line of the side gusset.

A method of making a film web that can be processed to form film bags with a carry handle starts with a planar strip of film having a inner layer forming an inner face of the bag and an outer layer forming an outer face of the bag. The film web is formed with attachment holes that form the connecting areas for the carry handles. The attachment holes are closed on the inner face with inner film patches that have self-adhesive connecting faces coated with adhesive and that are attached by contact to the inner face of the film web. As carry handles, strips of film are used that have self-adhesive handle ends coated with adhesive and are placed onto the outer face of the film web in such a manner that the handle ends of the carry handles adhere to the film web over and around the attachment holes and so as to be are fixedly bonded through the attachment holes to the film patches by contact with the self-adhesive connecting face of the film patches.

Outer film patches can be applied over and around the handle ends of the carry handles to the outer face of the bag panel. Preferably, the outer patches are substantially bigger than the respective handle ends so as to provide solid reinforcement in this region.

As adhesives, contact adhesives can be used that bond permanently to plastic. For generating a full-contact and strong adhesive connection it is of advantage if the material web is moved through a device in which the adhesive connections are pressed against each other.

The carry handles and the film patches are peeled like self-adhesive labels from a carrier film and are applied onto the film web.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
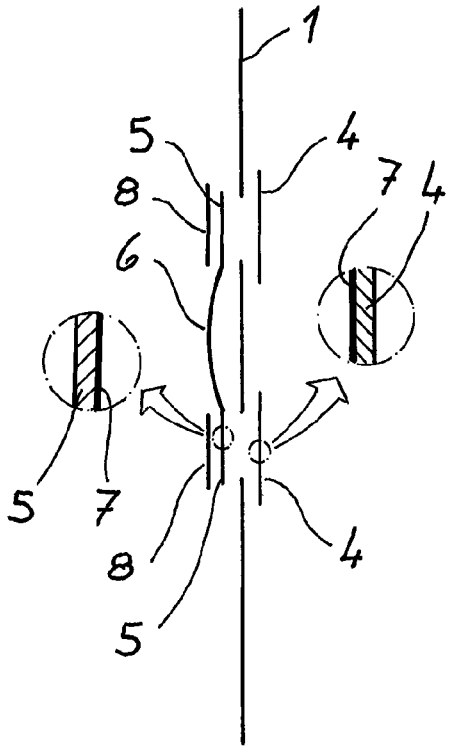
FIG. 1*b* is a longitudinal section through the bag shown in FIG. 1 in the region of the handle.
Figure 1A:
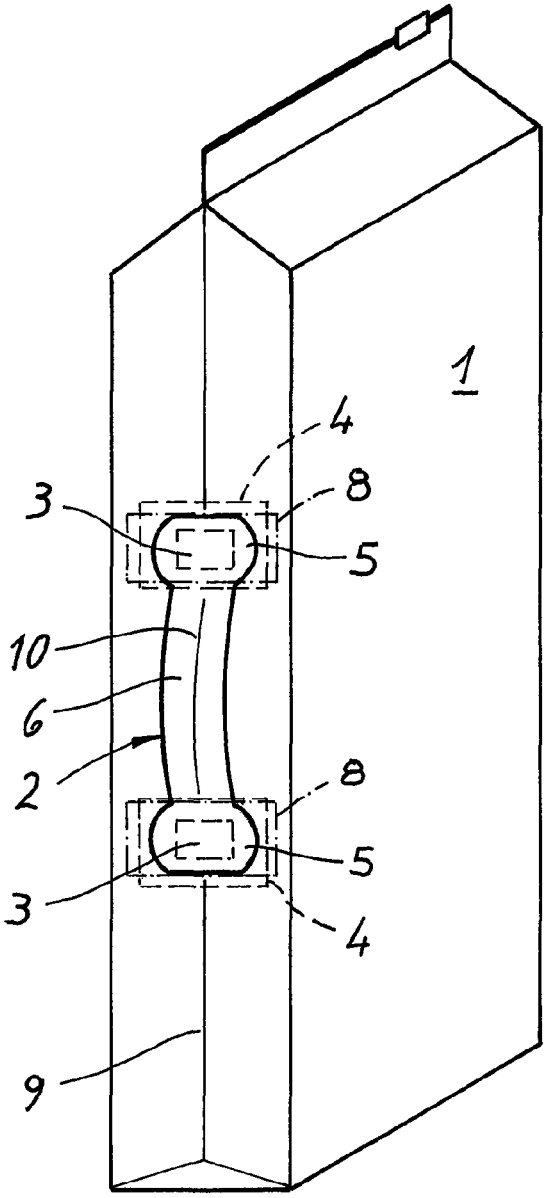
FIG. 1*a* is a perspective view of a bag with a handle for lumpy, granular or powdery bulk material.

As seen in FIG. 1*a* a bag is made from a plastic film 1 and has a carry handle 2 made from a separate strip of film. As is standard, the bag is made of one piece of the film 1 and has a pair of rectangular and substantially identical front and back panels joined at their normally vertical edges by side gussets each having a centerline crease 9. The bag serves for packaging lumpy, granular or powdery bulk material and can optionally have a reclosable fastener.

FIG. 1*b* further shows that the plastic film is provided with attachment holes 3 for the carry handle 2. The attachment holes 3 are each covered on an inner face of the respective bag panel by at least one inner film patch 4 attached to an inner face of the bag. The carry handle 2 has wide handle ends 5 and a narrow handle area 6 between them. The handle ends 5 are bonded through the holes 3 to the respective film patches 4. The connection is formed by adhesive. To this end, the film patch 4 and the handle ends 5 of the carry handle 2 have confronting faces 7 completely coated with contact adhesive so they bond to each other through the attachment holes 3 by contact of the adhesive faces on the two sides and also bond to the outer and inner faces of the film 1 around the attachment holes 3.

To strengthen the carry handle 2, an outer film patch 8 can be provided overlying each of the handle ends 5 of the carry handle 2, these outer film patches 8 being similarly fully coated with adhesive to bond around the outer peripheries of the respective ends 5 with the outer face of the plastic film 1 of the bag. The additional outer film patch 8 is optional and is only necessary if the carrying handle is intended to be subject to a particularly high load. With this system the entire load borne by the handle 2 is distributed over a fairly large region at each end 5, this region being of greater surface area than the respective end 5 and also being reinforced internally by the respective patch 4 and externally by the respective patch 8.

Figure 2B:
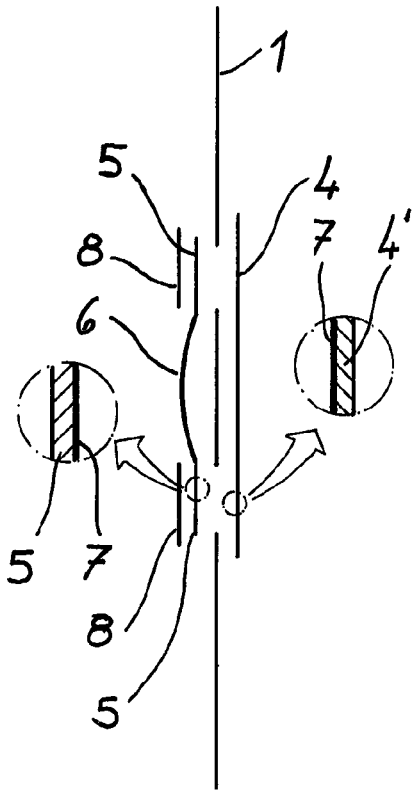
FIGS. 2*a* and 2*b* are views like FIGS. 1*a* and 1*b*, respectively, showing another bag according to the invention.
Figure 2A:
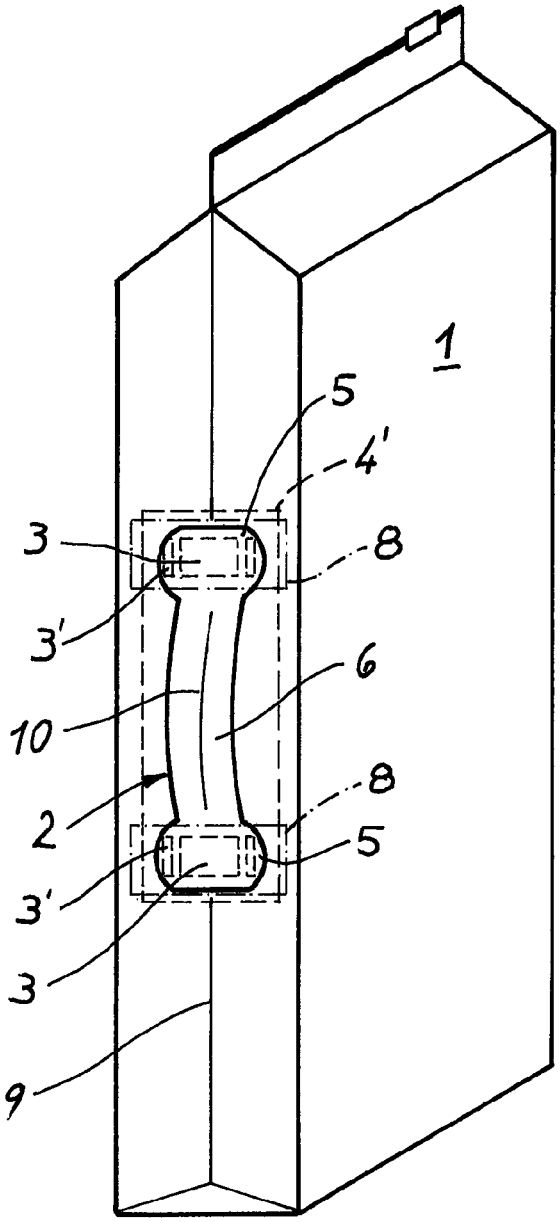

FIGS. 2*a* and 2*b* show a further embodiment of the bag according to the invention. Here, a single inner film patch 4' covers the attachment holes 3 of both handle ends 5 of the carry handle 2 and has a rectangular spot 7 of adhesive at each of the ends 5. FIG. 2*a* shows further that the plastic film 1 has an array of three attachment holes 3 and 3' at each of the adhesive spots 7 of the film patch 4' and the carry handle 2. Thus at each handle end 5 there is a large center hole 3 flanked by a pair of smaller slot-shaped holes 3', with ribs of the film 1 extending between them. Thus, the load bearing zones can be specifically strengthened and the connection between the carry handle 2 and the plastic film 1 of the bag can be further improved. Here too, the outer film patches 8 strengthen the carry handle 2, overlie the handle ends 5 of the carry handle 2, and are glued where they project past the edges of the ends to the outer face of the plastic film 1.

Figure 3:
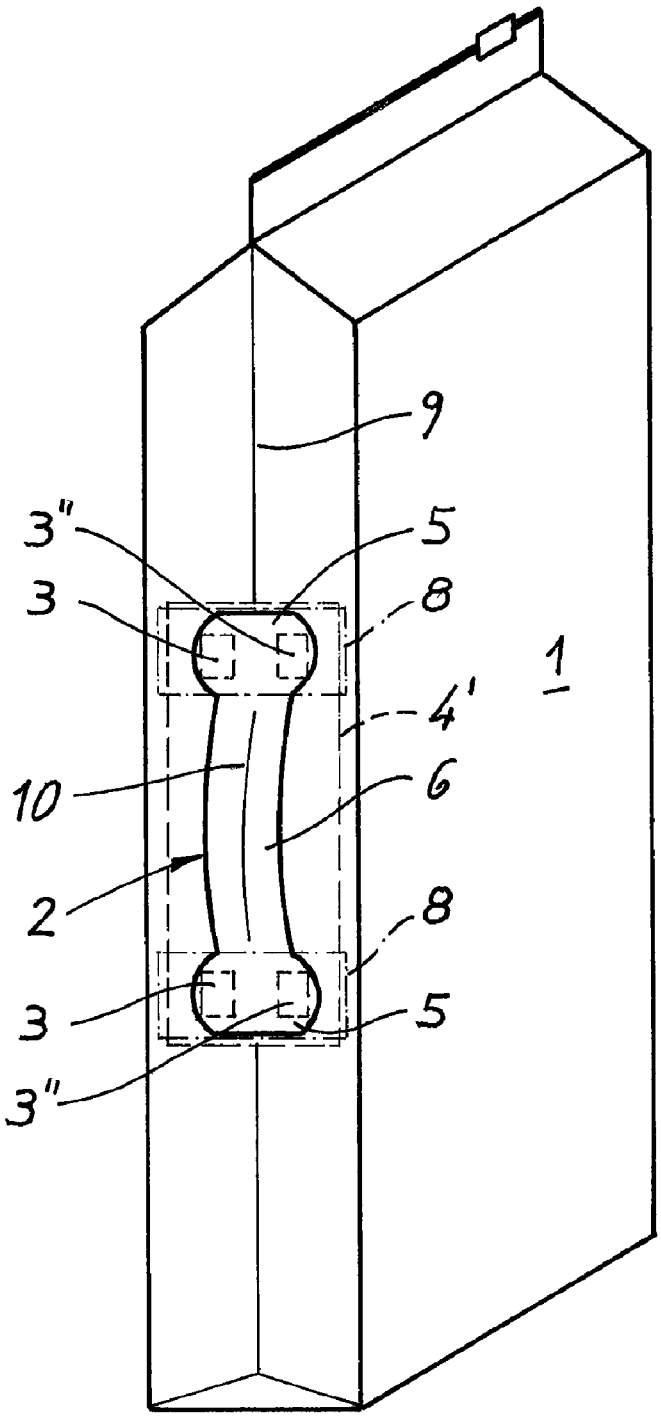
FIG. 3 is a perspective view of another bag in accordance with the invention.

FIG. 3 shows an embodiment where the plastic film 1 also has two identical attachment holes 3 and 3" at the adhesive spots 7 of the film patch 4' and ends 5 of the carry handle 2. The attachment holes 3 and 3" are square and off-center, that is they spacedly symmetrically flank the midline crease 9 of the side panel they are mounted on. The carrying force applied to the carry handle 2 is first transmitted to a central connecting area in which the carry handle 2 is glued only to the outer surface of the bag. From there, the forces are uniformly distributed to the left and to the right of the midline at the attachment holes 3 and 3", where the handle ends 5 of the carry handle 2 and the inner film patch 4' are firmly anchored to one another by direct adhesive contact. Force transmission and force distribution can be optimized by the number of attachment holes per adhesive 7, their size, and their relative orientation.

In the embodiments of FIGS. 1*a* to 3, the carry handle 2 is mounted on a side-panel gusset of the bag and lies initially substantially in surface contact flatly against the outer face of the side gusset, where it has a fold 10 corresponding to the crease 9 of the side gusset panel.

Figure 4:
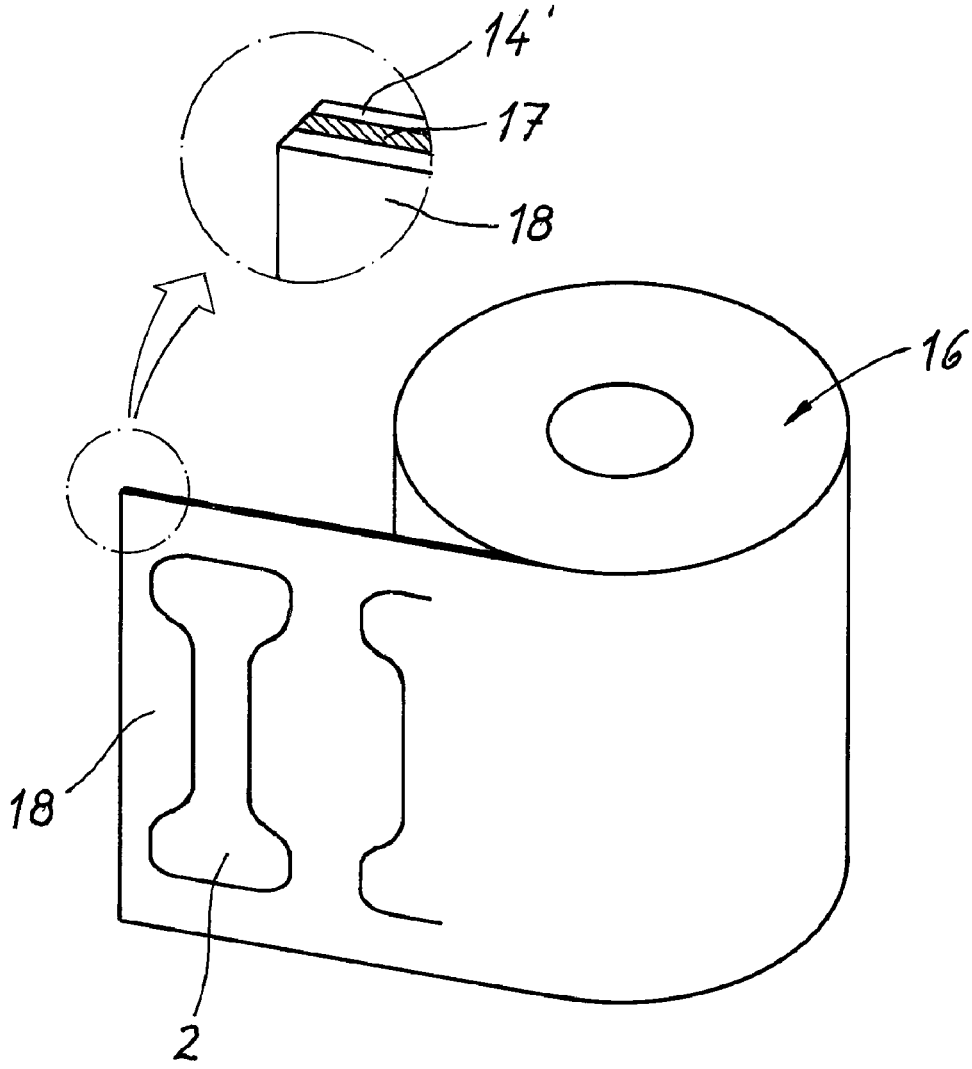
FIG. 4 is a perspective view of a roll of label film for the handle.

The carry handles 2 can be supplied to the bag fabricator like standard self-adhering labels, mounted on a composite film 16 as shown in FIG. 4. The composite film 16 can be unwound from the roll and consists of a carrier film 14', a contact adhesive layer 17, and a laminated film 18. The carry handles 2 are punched out of the upper film 18. They are removed like standard self-adhesive labels from the carrier film 14' and applied to the film web 11.

Figure 5:
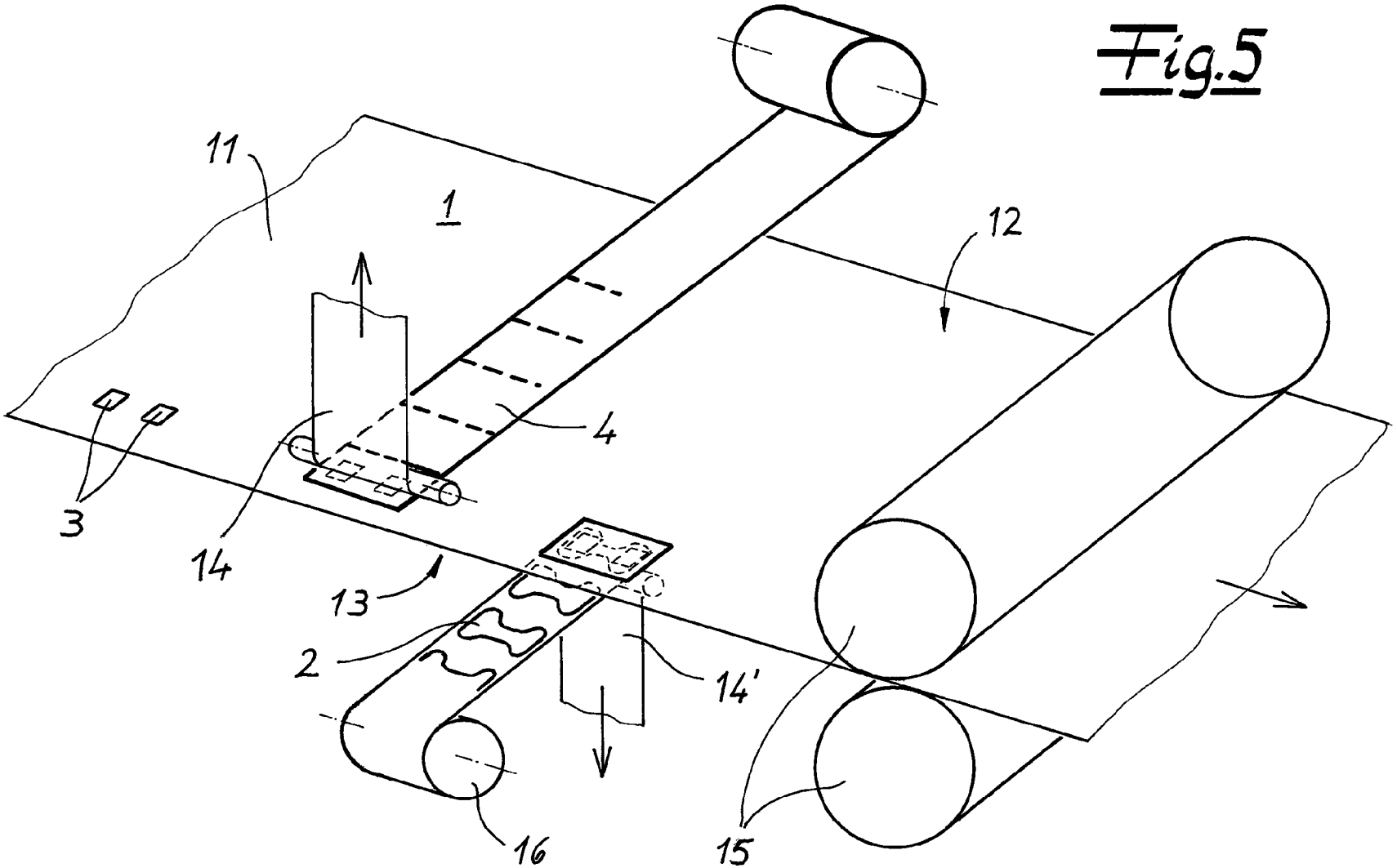
FIG. 5 is a simplified process diagram for manufacturing a film web that can be processed to form film bags with a flexible carrying handle.

FIG. 5 shows very schematically a method of making a web blank that can be further processed to form film bags with a carry handle. Thus a flat film web 11 made from the plastic film 1 has an inner layer 12 forming an inner face of a bag and an outer layer 13 forming the outer face of the bag. Attachment holes 3 are die-cut into the film web and form the connecting areas for the carry handles 2. The attachment holes 3 are covered on the side 12 with film patches 4 that coated with adhesive to bond solidly to the inner layer 12 of the film web 11. The film patches 4 are formed like self-adhesive labels and stripped from a carrier film 14 and applied to the film web 11.

As carry handles 2, strips of film are used that have the above-described self-adhering handle ends 5 coated with adhesive. The carry handles 2 are secured to the outer layer 13 of the film web 11 in such a manner that their handle ends adhere to the film web 11 over the attachment holes 3 and are fixedly connected with the film patches 4 on the other side of the attachment holes 3 by contact with the self-adhesive connecting face of the film patch 4. The carry handles 2 as well as the film patches 4 are removed as self-adhesive labels from the above-described rolled-up carrier film 14' and are applied onto the film web 11.

To make a firm and flat connection, the material is finally passed through the nip between two pressure rolls 15 that firmly press the handles 2 against the outer face 13 and the patches 4 against the inner face 12 and the handle ends 5 through the holes 3 (and/or 3' and/or 3") directly with the patches 4, forming a permanent adhesively bonded connection.

The film web that has been provided with carry handles according to the described method can be processed in a standard bag-manufacturing plant to form bags that have a carry handle. To this end, the material web is folded, formed into a tube and is transferred through sealing stations in which longitudinal sealing seams and transverse sealing seals are generated. With respect to the further processing of the material web, known technologies for bag manufacturing can be used.

What is claimed is:

1. A bag comprising:

a panel made of plastic film and having an inner face and an outer face and formed with a pair of throughgoing and spaced attachment holes;

a carry handle made of plastic film and having a pair of spaced ends each having an adhesive-coated face engaging the outer face over a respective one of the holes; and respective inner patches each having an adhesive-coated face engaging the inner face over a respective one of the holes and engaged through the respective hole with the end face.

2. The film bag defined in claim 1 wherein each of the inner patches is of larger surface area than the respective attachment hole and engages the inner face all around the respective attachment hole.

3. The film bag defined in claim 2 wherein the inner patches are separate and spaced apart on the inner face.

4. The film bag defined in claim 2 wherein the inner patches are both parts of a common piece of film.

5. The film bag defined in claim 1 wherein the panel is formed at each of the ends with a plurality of the attachment holes covered on the inner face by the respective patch and on the outer face by the respective handle end.

6. The film bag defined in claim 5 wherein the attachment holes spacedly flank a centerline of the panel.

7. The film bag defined in claim 1 wherein the patches and handle ends are completely coated on respective faces engaging the inner and outer faces of the bag with the respective adhesive.

8. The film bag defined in claim 1 wherein the handle has a center part that extends between the respective ends and that is substantially narrower than the ends.

9. The film bag defined in claim 1, further comprising:

respective outer patches each engaging over a respective one of the ends and each having an adhesive-coated face engaging the respective end and engaging the film outer face around the respective end.

10. The film bag defined in claim 1 wherein the panel is a side panel of the bag extending between front and back panels.

11. The film bag defined in claim 10 wherein the side panel has a center crease and the handle has a center crease aligned therewith.

12. The film bag defined in claim 10 wherein there are two such attachment holes at each of the handle ends symmetrically and spacedly flanking the crease.

13. A method of making a film web for fabrication of a bag, the method comprising the step of:

forming a strip of film having an inner face and an outer face with a pair of spaced and throughgoing attachment holes;

applying to the inner face over and around each of the attachment holes an adhesive-coated face of an inner patch;

applying to the outer face over and around each of the attachment holds an adhesive-coated face of an end of a carry handle made of film; and bonding together the inner patches and the respective handle ends through the respective attachment holes.

14. The film-making method defined in claim 13, further comprising the step of:

compressing together each of the handle ends, the strip of film, and the inner patches to bond them solidly together.

15. The film-making method defined in claim 14 wherein the ends, strip of film, and inner patches are compressed together by being passed between a pair of pinch rollers.

16. The film-making method defined in claim 13, further comprising the step of:

applying to the outer face over and around each of the handle ends an adhesive-coated face of an outer patch.

17. The film-making method defined in claim 13 wherein the inner patches are peeled off a carrier strip before being applied to the strip of film.

18. The film-making method defined in claim 13, further comprising the step after application of the inner patches and carry handle and bonding together of the patches and handle ends of:

forming the strip of film into a tube and forming it by longitudinal and transverse welds into a bag blank.

* * * * *